US012064016B2

(12) United States Patent
Mojica

(10) Patent No.: US 12,064,016 B2
(45) Date of Patent: Aug. 20, 2024

(54) BUCKLE ASSEMBLY WITH SHARPENING TOOL

(71) Applicant: OUTDOOR ELEMENT, LLC, Englewood, CO (US)

(72) Inventor: Michael John Mojica, Englewood, CO (US)

(73) Assignee: OUTDOOR ELEMENT, LLC, Englewood, CO (US)

( * ) Notice: Subject to any disclaimer, the term of this patent is extended or adjusted under 35 U.S.C. 154(b) by 384 days.

(21) Appl. No.: 17/423,829

(22) PCT Filed: Jan. 17, 2020

(86) PCT No.: PCT/US2020/014009

§ 371 (c)(1),
(2) Date: Jul. 16, 2021

(87) PCT Pub. No.: WO2020/150562

PCT Pub. Date: Jul. 23, 2020

(65) Prior Publication Data

US 2022/0110419 A1 Apr. 14, 2022

Related U.S. Application Data

(60) Provisional application No. 62/794,416, filed on Jan. 18, 2019.

(51) Int. Cl.

| | |
|---|---|
| ***A44B 11/00*** | (2006.01) |
| ***B24B 3/36*** | (2006.01) |
| ***B24D 15/08*** | (2006.01) |

(52) U.S. Cl.
CPC ..... *A44B 11/005* (2013.01); *B24B 3/36* (2013.01); *B24D 15/08* (2013.01)

(58) Field of Classification Search
CPC ..... A44B 11/1005; B24B 3/36; B24B 15/08
See application file for complete search history.

(56) References Cited

U.S. PATENT DOCUMENTS 5,009,040 A 4/1991 Petroff
6,668,428 B2 * 12/2003 Moeller ..... A44B 11/005 24/198

(Continued)

OTHER PUBLICATIONS

International Search Report issued in PCT/US2020/014009 on Apr. 17, 2020, 2 pgs.

(Continued)

*Primary Examiner* — Christine M Mills
*Assistant Examiner* — Matthew J Sullivan
(74) *Attorney, Agent, or Firm* — Holland & Hart LLP

(57) ABSTRACT

Various embodiments of the present invention are generally directed to a buckle assembly for sharpening a cutting tool. A quick release buckle assembly is provided including: a male buckle component having a pair of resiliently flexible legs and a sharpener receiver disposed between the pair of resiliently flexible legs; a female buckle component having a socket portion configured to receive the pair of resiliently flexible legs and the sharpener receiver disposed between the pair of resiliently flexible legs; and a first sharpening rod having a first sharpening edge and a second sharpening rod having a second sharpening edge.

6 Claims, 17 Drawing Sheets

(56) References Cited

U.S. PATENT DOCUMENTS

| | | | | |
|---|---|---|---|---|
| 8,312,602 | B2 * | 11/2012 | Paik | A44B 11/266 24/163 R |
| 9,168,627 | B2 * | 10/2015 | Elek | B24B 3/54 |
| 9,380,842 | B1 * | 7/2016 | Bigelow | A44C 5/24 |
| 9,649,749 | B2 * | 5/2017 | Weiner | B24D 15/08 |
| 9,693,644 | B1 * | 7/2017 | Liu | B24D 15/081 |
| 9,986,789 | B2 * | 6/2018 | Blackman | A44B 11/2592 |
| 10,076,146 | B2 * | 9/2018 | Kennedy | F41B 13/00 |
| 10,219,585 | B2 * | 3/2019 | Taylor | A44B 11/006 |
| 10,219,587 | B1 * | 3/2019 | Chan | A44B 11/04 |
| 10,321,752 | B2 * | 6/2019 | Zentil | B25G 1/085 |
| 11,089,842 | B2 * | 8/2021 | Millward | A44B 11/266 |
| 11,253,968 | B2 * | 2/2022 | Chalfant | B24D 15/08 |
| 2007/0167122 | A1 | 7/2007 | Henry | |
| 2007/0171629 | A1 * | 7/2007 | Langenwalter | A44B 11/266 362/108 |
| 2010/0014284 | A1 * | 1/2010 | Hancock | B24D 15/08 362/205 |
| 2012/0180602 | A1 | 7/2012 | Murphy | |
| 2013/0189631 | A1 * | 7/2013 | Mojica | F23Q 1/06 431/274 |
| 2013/0224667 | A1 | 8/2013 | Roybal | |
| 2014/0109615 | A1 | 4/2014 | Millan | |
| 2016/0021984 | A1 * | 1/2016 | Mundhra | A44B 11/266 116/137 R |
| 2022/0193853 | A1 * | 6/2022 | Meek | B24D 15/084 |

OTHER PUBLICATIONS

Written Opinion of the International Searching Authority Issued in PCT/US2020/014009 on Apr. 17, 2020, 5 pgs.

* cited by examiner

BUCKLE ASSEMBLY WITH SHARPENING TOOL

CROSS-REFERENCE TO RELATED APPLICATIONS

This application claims priority to U.S. Provisional Patent Application No. 62/794,416, filed Jan. 18, 2019, the entirety of which is hereby incorporated by reference.

BACKGROUND

1. Technical Field

The present disclosure relates to a buckle assembly, and more particularly to a buckle assembly for sharpening a blade.

2. Introduction

Buckle assemblies have been widely implemented in various forms, including as a quick release buckle assembly. Quick release buckle assemblies are used in many applications such as for belts, backpacks, utility straps, and other applications to releasably connect two ends. Conventional buckle assemblies do not provide an enclosable sharpener for sharpening a blade.

SUMMARY

Various embodiments of the present disclosure are generally directed to a buckle assembly for sharpening a blade.

In accordance with some embodiments, the buckle assembly may comprise a male buckle component having a pair of resiliently flexible legs and a sharpener receiver disposed between the pair of resiliently flexible legs; a female buckle component having a socket portion configured to receive the pair of resiliently flexible legs and the sharpener receiver disposed between the pair of resiliently flexible legs; and a first sharpening rod having a first sharpening edge and a second sharpening rod having a second sharpening edge. The first sharpening rod and the second sharpening rod may be at least partially or completely disposed in the sharpener receiver. The first sharpening edge and the second sharpening edge may be at least partially or completely exposed from the male buckle component and configured to sharpen a blade. When the male buckle component is received by the female buckle component, the first sharpening edge and the second sharpening edge may at least partially or completely covered by the female buckle component.

In accordance with some embodiments, the buckle assembly may comprise a male buckle component having a pair of resiliently flexible legs; a female buckle component having a first socket portion configured to receive the pair of resiliently flexible legs and a sharpener receiver; and a first sharpening plate having a first sharpening edge and a second sharpening plate having a second sharpening edge. The first sharpening plate and the second sharpening plate may be at least partially or completely disposed in the sharpener receiver and extend outwardly therefrom. The first sharpening edge and the second sharpening edge may be at least partially or completely exposed from the female buckle component and configured to sharpen a blade. When the male buckle component is received by the female buckle component, the first sharpening plate and the second sharpening plate may be adjacent to, directly adjacent to, or in contact with a top surface of the male buckle component.

Additional features and advantages of the disclosure will be set forth in the description which follows, and in part will be obvious from the description, or can be learned by practice of the herein disclosed principles. The features and advantages of the disclosure can be realized and obtained by means of the buckle assemblies and combinations particularly pointed out in the appended claims.

BRIEF DESCRIPTION OF THE DRAWINGS

Example embodiments of this disclosure are illustrated by way of examples and not limited in the figures of the accompanying drawings, in which like references indicate similar elements and in which.

Figure 1:
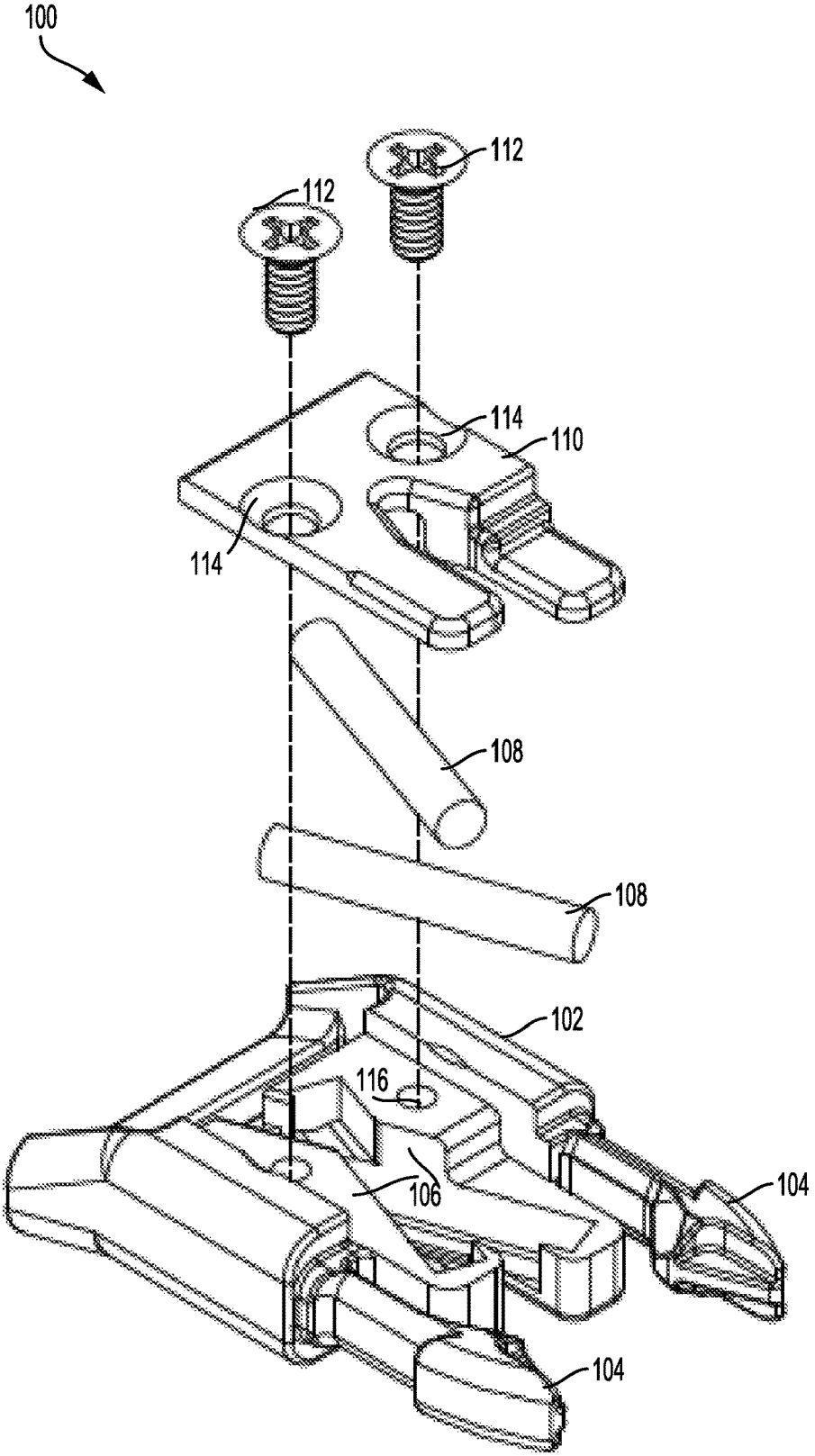
FIG. 1 is an exploded perspective view of a male buckle component having a sharpener in accordance with a first embodiment in the present disclosure.

It is to be understood that both the foregoing general description and the following detailed description are example and explanatory and are intended to provide further explanations of the invention as claimed only and are, therefore, not intended to necessarily limit the scope of the disclosure.

DETAILED DESCRIPTION

Various example embodiments of the present disclosure will be described in detail below with reference to the accompanying drawings. Throughout the specification, like reference numerals denote like elements having the same or similar functions. While specific implementations and example embodiments are described, it should be understood that this is done for illustration purposes only. Other components and configurations may be used without parting from the spirit and scope of the disclosure, and can be implemented in combinations of the variations provided. These variations shall be described herein as the various embodiments are set forth.

The present disclosure provides a buckle assembly having a sharpener for sharpening a blade or cutting tool. The buckle assembly may comprise a male buckle component and a female buckle component that can be releasably coupled to the male buckle component. The sharpener may be disposed on the male buckle component, the female buckle component, or both the male buckle component and the female buckle component. The sharpener may also be referred to as a sharpener feature or module.

As disclosed herein, the buckle assembly may be any suitable buckle assembly for releasably connecting together two ends of a strap or other object such as, for example, but not limited to a quick release buckle assembly. The buckle assembly may be used for bracelets, duffle bags, belts, clothing, backpacks, straps, ropes, poles, or other items. The buckle assembly may vary in shape and design. For example, the ends of the buckle assembly may be configured to receive webbing, cordage, bonded through materials, etc. The ends of the buckle assembly may have locking designed for webbing for folding back for self-locking. The buckle assembly may also be designed to be a "replacement" buckle assembly with a split in the cross member or have a latch mechanism.

Embodiment 1

FIG. 1 illustrates an exploded perspective view of a male buckle component 100 of a buckle assembly having a sharpener in accordance with a first embodiment. The male buckle component 100 may generally comprise a base body 102, a pair of legs 104 integrally formed with or coupled to the base body 102, a sharpener receiver 106 disposed in or coupled to the base body 102, and a set of sharpening rods 108 to be received in the sharpener receiver 106. According to an embodiment, the male buckle component 100 may further comprise a holding member 110 for holding the set of sharpening rods 108 in the sharpener receiver 106, and a set of screws 112 to fix the holding member 110 to the base body 102. According to an embodiment, the holding member 110 may be formed integrally with the base body 102 so that no screws are needed to fix the holding member 110 to the base body 102.

The base body 102 may have any suitable shape and design pattern, for example, a safety buckle shape.

Figure 2:
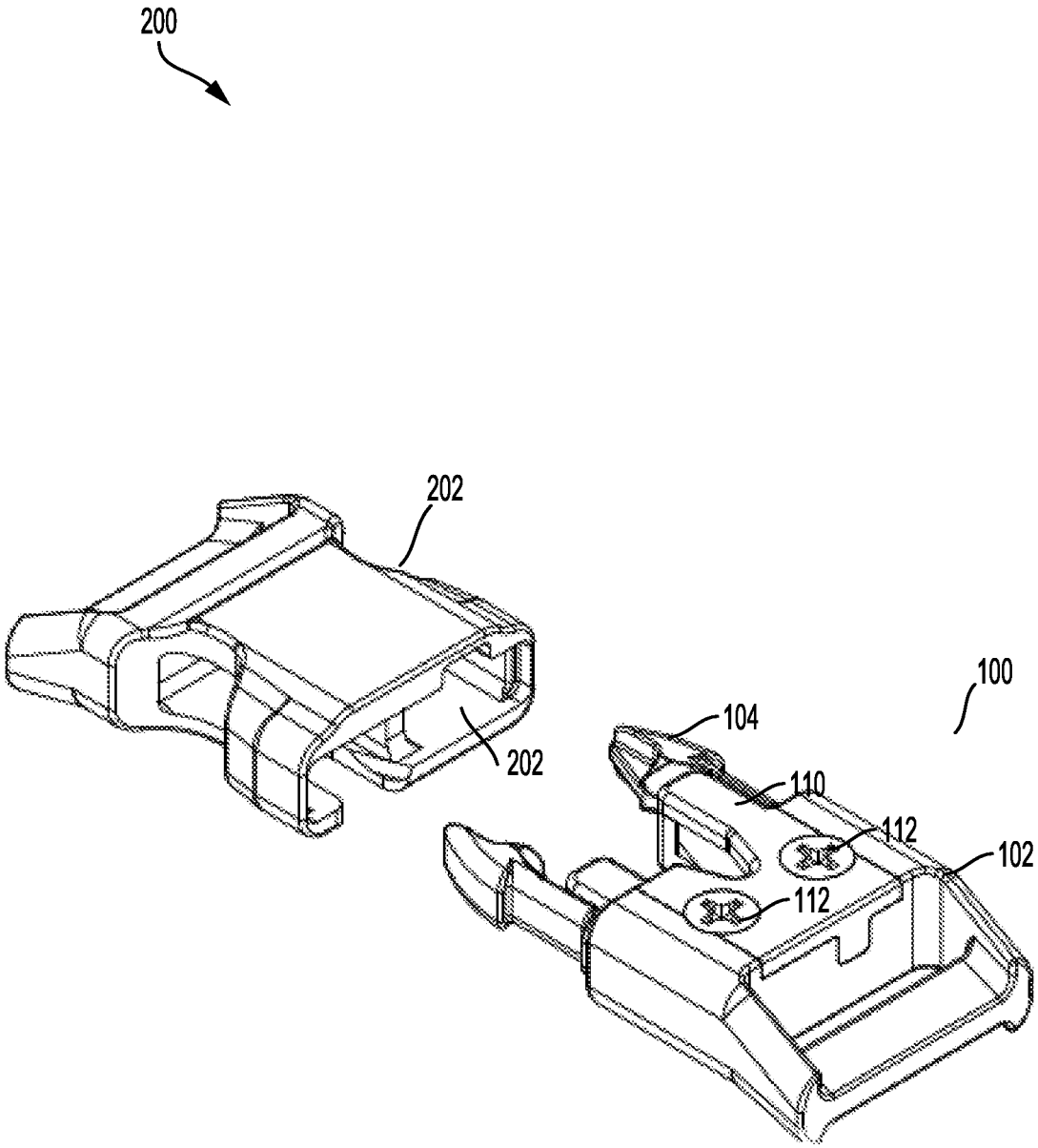
FIG. 2 is a perspective view of a buckle assembly including the male buckle component and a female buckle component in accordance with the first embodiment.

The pair of legs 104 may be a pair of resiliently flexible legs, and may be configured to have various shapes. The pair of legs 104 can be received by a female buckle component 202 of the buckle assembly having a socket portion configured to receive the pair of resiliently flexible legs, such as depicted in FIG. 2.

The sharpener receiver 106 may be configured to receive the set of sharpening rods 108. The sharpener receiver 106 may be configured as a set of recesses in the base body 102, and may have varying shapes and dimensions depending on the shape and dimensions of the sharpening rods 108. The sharpener receiver 106 may be disposed between the pair of resiliently flexible legs 104. When the male buckle component 100 is received by the female buckle component 202, each of the resiliently flexible legs 104 may pivot or bend inwardly towards the sharpener receiver.

The set of sharpening rods 108 may be made of ceramic or other materials for sharpening a cutting tool, such as fine sharpening. Although the cross-sectional shape of the set of sharpening rods 108 is shown to be round in this example embodiment, the cross-sectional shape of the set of sharpening rods 108 may be configured to be other shape, such as a triangle or other shape suitable for sharpening a blade. Each of the sharpening rods 108 may have a sharpening edge for sharpening a cutting tool, such as a blade or a knife, such as fine sharpening a cutting tool.

The sharpening rods 108 may be at least partially or completely disposed in the sharpener receiver 106. The sharpening edges of the sharpening rods 108 may be at least partially or completely exposed from the male buckle component to sharpen a blade. According to an embodiment, when the male buckle component is received by the female buckle component, the sharpening edges of the sharpening rods 108 may be at least partially or completely covered by the female buckle component.

According to an embodiment, one rod (referred as a first sharpening rod) of the sharpening rods 108 may be positioned on another rod (referred to as a second sharpening rod) of the sharpening rods 108 to form an angled intersection of the sharpening edge of the first sharpening rod and the sharpening edge of the second sharpening rod. The angled intersection may be defined by sharpener receiving member 106. For example, for cylindrical shaped sharpening rods 108, the sharpener receiving member 106 may define a lower cylindrical receiving area for receiving the second or lower sharpening rod and an upper cylindrical receiving area for receiving the first or upper sharpening rod. The lower cylindrical receiving area and the upper cylindrical receiving area may generally define the angled intersection such that when the sharpening rods 108 are received by the lower cylindrical receiving area and the upper cylindrical receiving area, the sharpening rods 108 are fixed in place at the determined angled intersection. According to an embodiment, the sharpening rods 108 received by the sharpener receiving member 106 may be held in place by a friction fit between the sharpening rods 108 and the sharpener receiving member 106.

According to an embodiment, the lower receiving area and the upper receiving area may be defined in shape and dimensions according to the shapes and dimensions of the first or lower sharpening rod and the second or upper sharpening rod to accommodate the first or lower sharpening rod and the second or upper sharpening rod, respectively. The lower receiving area and the upper receiving area may each have a bottom surface on which the lower sharpening rod sits partially or completely and the upper sharpening rod sits partially or completely, respectively. According to an embodiment, the lower receiving area and the upper receiving area may each have a top opening opposite to the bottom surface from which the lower sharpening rod may partially or completely be disposed and the upper sharpening rod may partially or completely be disposed, respectively.

According to an embodiment, the lower receiving area and the upper receiving area may each have an inner side opening. For example, the inner side openings may be substantially perpendicular to the bottom surface of the buckle body. The partially open side surfaces may expose the sharpening edges of the sharpening rods, such that a blade can fit between the sharpening edges to be sharpened. In particular, the angled intersection of the sharpening rods may be exposed through the inner side openings.

According to an embodiment, the lower receiving area and the upper receiving area may define end caps of the lower and upper receiving areas, respectively. Such end caps may facilitate fixing the sharpening rods into the lower and upper receiving areas and prevent the sharpening rods from falling out of the lower and upper receiving areas.

According to embodiments, the angled intersection may be one of a variety of angles or within a range of angles. For example, the angled intersection may be less than 10°, within a range of about 10° to about 17°, within a range of about 22° to about 30°, greater than about 30°, within a range of about 30° to about 60°, or about 40°. According to an embodiment, the sharpening edge of the first sharpening rod and the sharpening edge of the second sharpening rod may form the angled intersection of about 40°.

According to an embodiment, the holding member 110 can be capable of affixing the sharpening rods 108 in place when the sharpening rods 108 are received by the sharpener receiving member 106. The holding member 110 may be configured to have any shape and dimension so long as the holding member 110 can match the base body 102.

According to an embodiment, the set of screws 112 may act as fasteners to facilitate holding the holding member 110 and the sharpening rods 108 to the base body 102. The set of screws 112 may pass through a pair of through holes 114 in the holding member 110 and be fixed into a pair of partially or fully threaded bores 116 in the base body 102. The set of screws 112 may be threaded or without threads, and may be any type and size, for example, smooth shank, ring shank, screw shank, etc.

In some embodiments, screws or other fasteners may not be used to facilitate affixing the holding member 110 and the sharpening rods 108 to the base body 102. For example, the holding member 110 may be configured to snap into the sharpener receiver 106, glued into to the sharpener receiver 106, or friction fit into the sharpener receiver 106. In some embodiments, the screws or other fasteners may be configured to fasten the holding member 110 from one side of the holding member 110 instead of the top of the holding member 110 as shown in FIG. 1.

In some embodiments, the holding member 110 may not be used to affix the sharpening rods 108 in place when the sharpening rods 108 are received by the sharpener receiving member 106. According to an embodiment, other methods may be applied to fasten the sharpening rods 108. For example, the sharping rods 108 may be fastened by a set of screws each threaded into the sharpener receiver 106 from side surfaces of the base body 102. Accordingly to an embodiment, a holding member 110 may be integrally formed with the base body 102.

FIG. 2 illustrates a perspective view of a buckle assembly 200 including the male buckle component 100 and a female buckle component in accordance with the first embodiment. The buckle assembly 200 may comprise the male buckle component 100 having the sharpener as described above and the female buckle component 202. The female buckle component 202 may be configured to receive the male buckle component 100 by receiving the pair of extended legs 104 of the male buckle component 100 into a socket portion 204 of the female buckle component 202.

Figure 3:
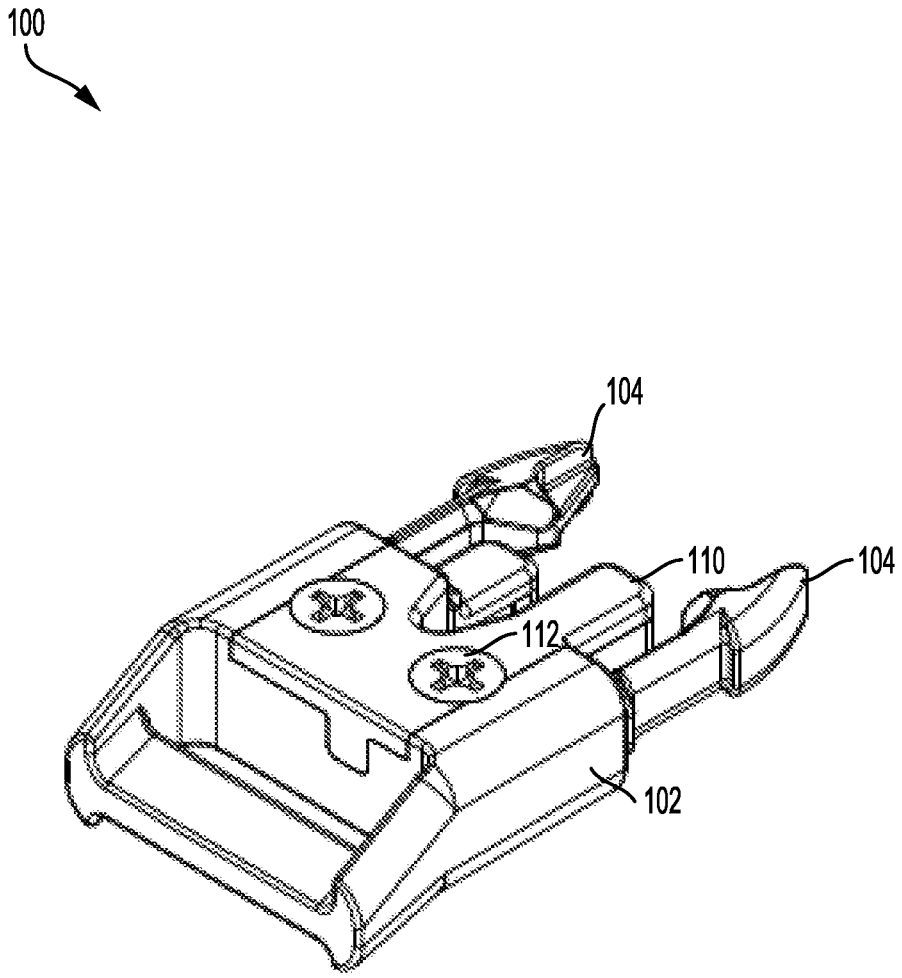
FIG. 3 is a perspective view of the male buckle component having the sharpener in accordance with the first embodiment.

FIG. 3 illustrates a perspective view of the male buckle component 100 having the sharpener in accordance with the first embodiment. The sharpener is assembled onto the base body 102.

Figure 4:
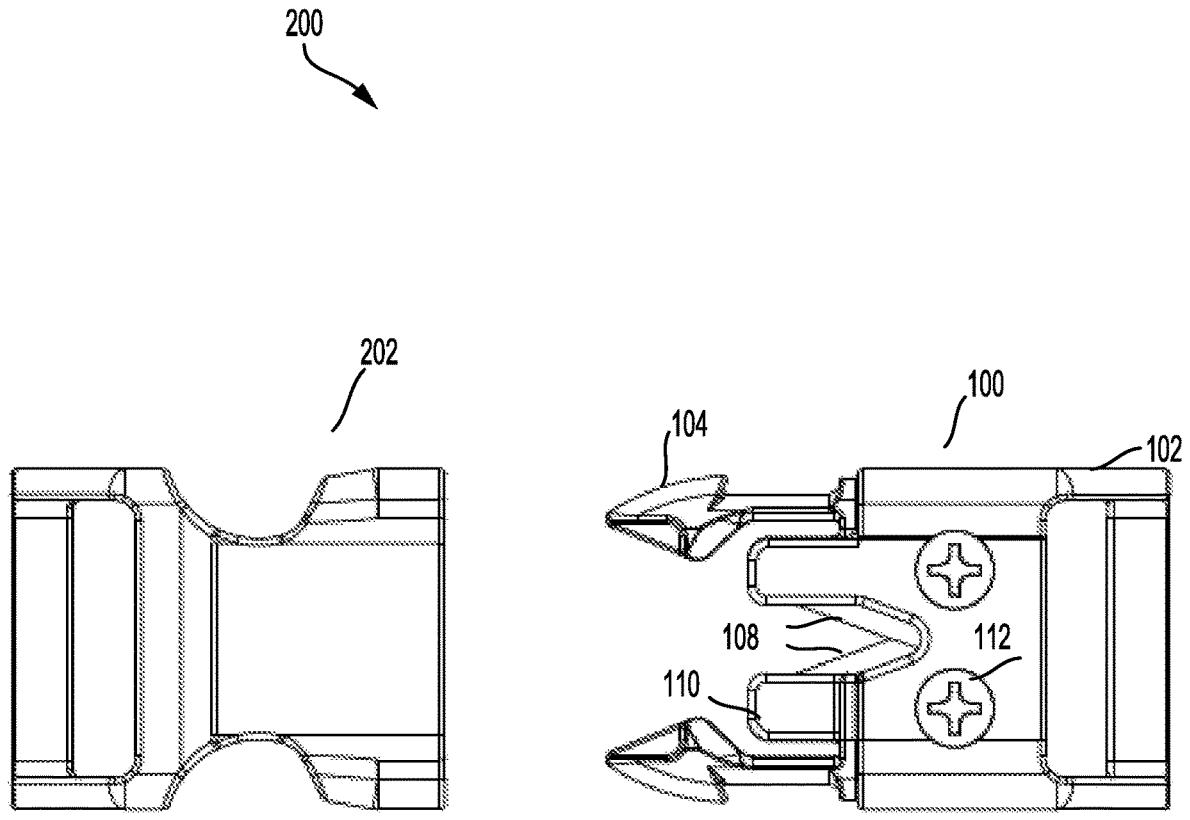
FIG. 4 is a top view of the buckle assembly with the male buckle component and the female buckle component in accordance with the first embodiment.

FIG. 4 illustrates a top view of the buckle assembly 200 with the male buckle component 100 and the female buckle component 202 in accordance with the first embodiment. As can be seen, the sharpening rods 108 form an angled intersections such that a cutting tool blade may be placed in between the angled intersection for being sharpened.

Figure 5:
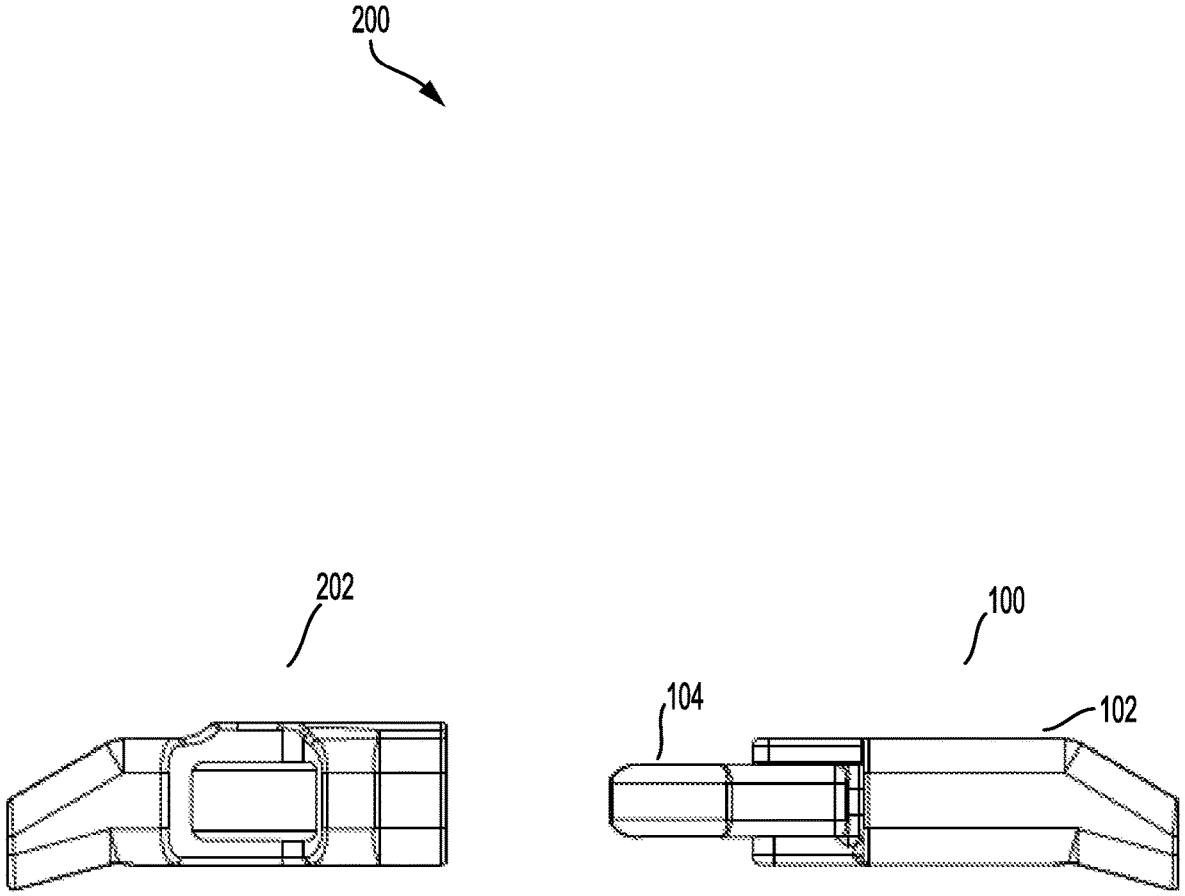
FIG. 5 is a side view of the buckle assembly with the male buckle component and the female buckle component in accordance with the first embodiment.

FIG. 5 is a side view of the buckle assembly 200 with the male buckle component 100 and the female buckle component 202 in accordance with the first embodiment. As can be seen, further details of the buckle assembly 200 are illustrated, for example, the shape sand profiles of the male buckle component 100 and the female buckle component 202. When the male buckle component 100 and the female buckle component 202 are assembled together, the sharpening rods 108 may be received by or located within the female buckle component 202. For example, the sharpening edge of the sharpening rods may be protected by the female buckle component 202 from external objects when the male buckle component 100 and the female buckle component 202 are assembled together.

Embodiment 2

Figure 6:
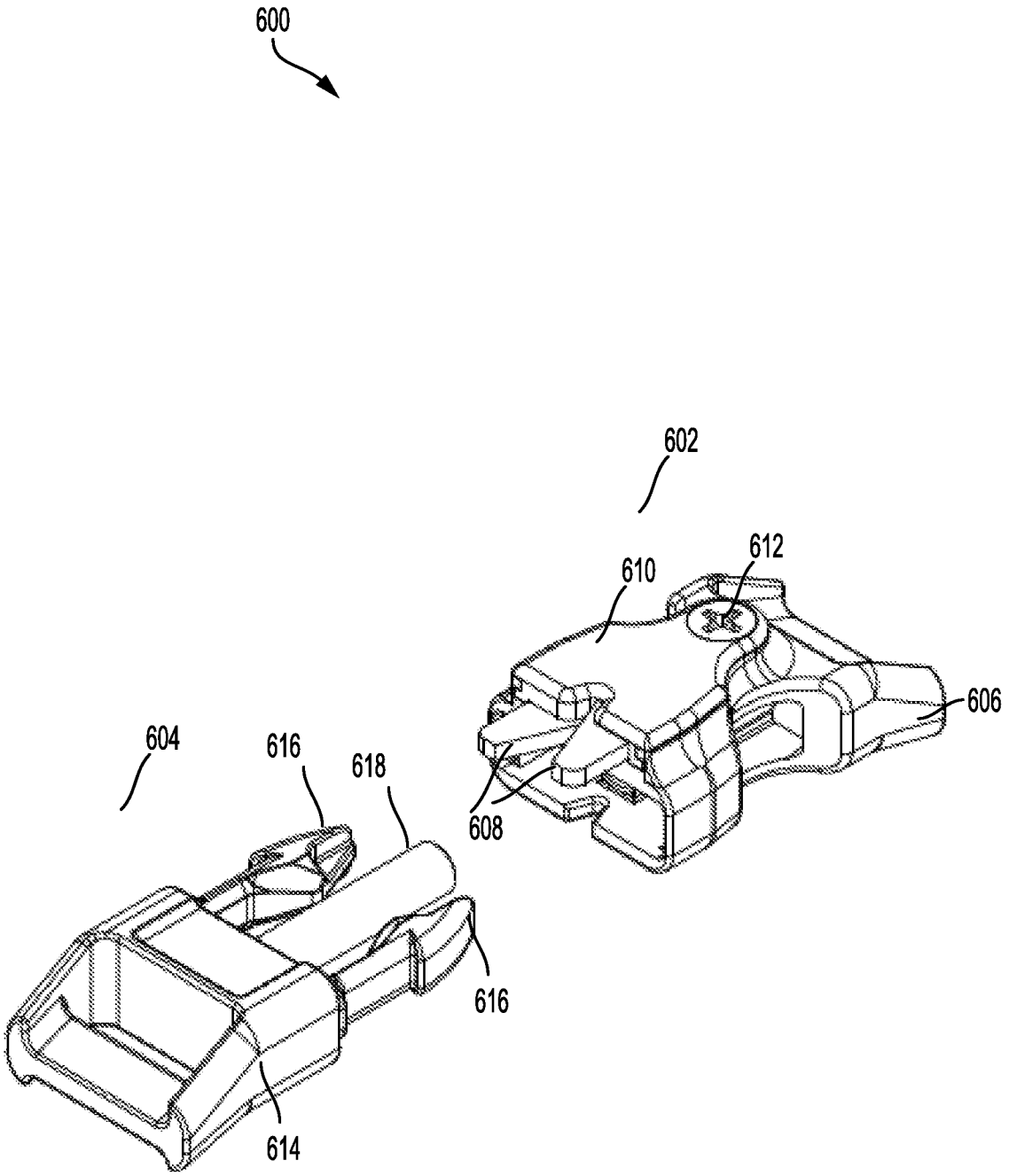
FIG. 6 is a perspective view of a buckle assembly with a female buckle component having a sharpener, and a male buckle component in accordance with a second embodiment.

FIG. 6 illustrates a perspective view of a buckle assembly 600 with a female buckle component 602 having a sharpener, and a male buckle component 604 in accordance with a second embodiment. The male buckle component 604 is configured to be received by the female buckle component 602, when the male buckle component 604 and the female buckle component 602 are engaged.

The female buckle component 602 may be configured to have a sharpener for sharpening a cutting tool or blade, such as coarse sharpening of a cutting tool or blade. The female buckle component 602 may comprise a base body 606, a set of sharpening plates 608 coupled to the base body 606, a holding member 610, and a screw 612.

The base body 606 may have any suitable shape and design pattern, for example, a safety buckle shape. The base body 606 may comprise a receiving area for receiving the set of sharpening plates 608. According to an embodiment the receiving area may be formed within a surface of the base body 606. For example, the receiving area may comprise a lower receiving area for receiving a first sharpening plate and an upper receiving area for receiving a second sharpening plate.

The set of sharpening plates 608 may be made of carbide or other materials for coarse sharpening a cutting tool and correction. The sharpening plates 608 may be configured to have any suitable shape and dimension. Each of the sharpening plates 608 may have a sharpening edge for sharpening a cutting tool, such as a blade or a knife.

Figure 8:
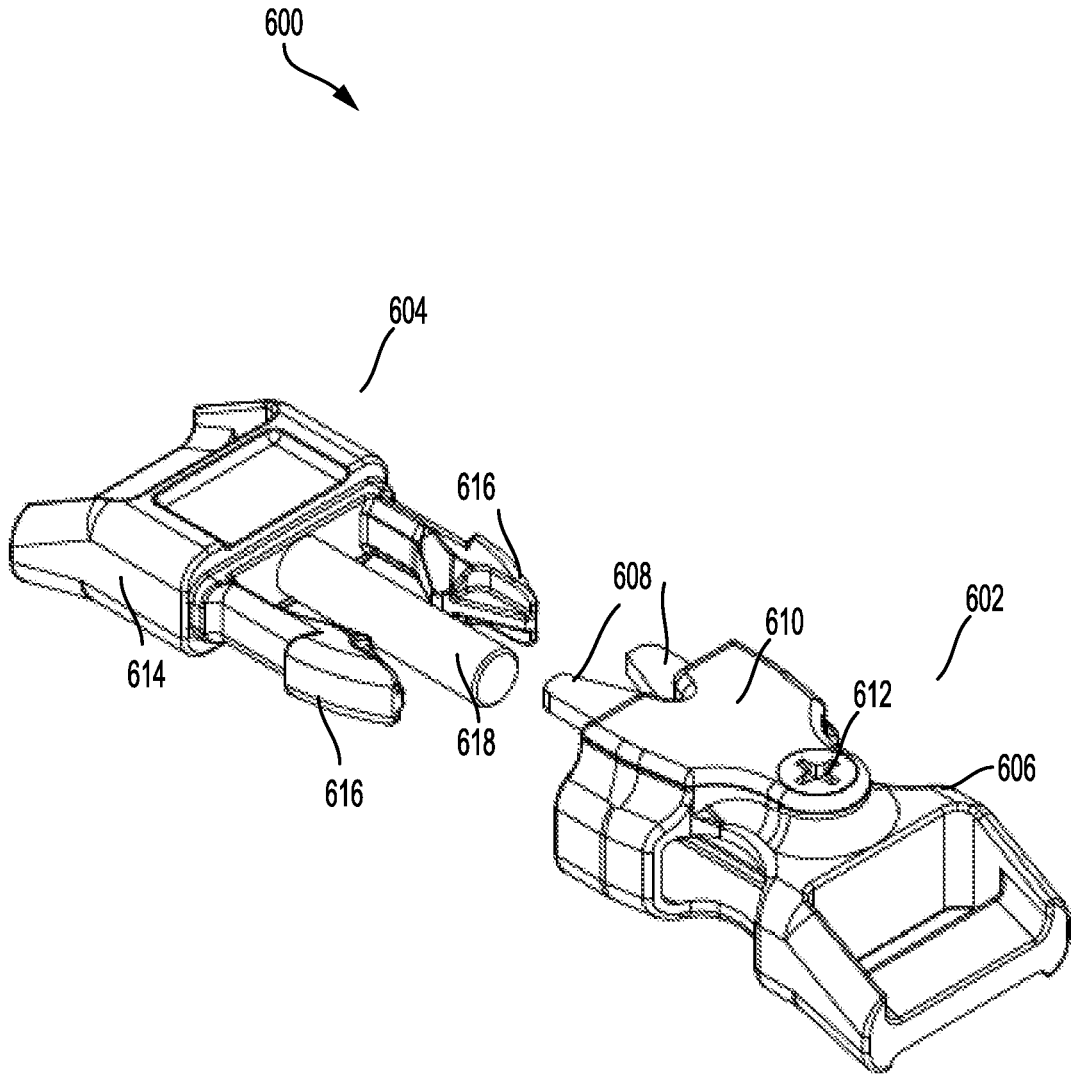
FIG. 8 is a perspective view of the buckle assembly with the female buckle component having the sharpener, and the male buckle component in accordance with the second embodiment.

The sharpening edges of the sharpening plates 608 may be at least partially or completely exposed from the female buckle component to sharpen a blade. Also when the male buckle component 604 is received by the female buckle component 602, the sharpening edges of the sharpening plates 608 may be at least partially or completely covered by the male buckle component 604. Further, when the male buckle component 604 is received by the female buckle component 602, the sharpening plates 608 may be adjacent or directly adjacent to a top surface of the male buckle component 604. According to an embodiment, when the male buckle component 604 is received by the female buckle component 602, one or both of the sharpening plates 608 may be in contact with a top surface of the male buckle component 604 such that one or both of the sharpening plates 608 are structurally supported by the male buckle component 604. According to an embodiment, a recess, as shown in FIG. 8, may be formed in the top surface of the male buckle component 604 to receive and support one or both of the sharpening plates 608.

According to an embodiment, the holding member 610 may affix the sharpening plates 608 in place onto the base body 606. The holding member 610 may be configured to have any shape and dimension so long as the holding member 610 can match the base body 606.

According to an embodiment, the screw 612 may act as a fastener to facilitate holding the holding member 610 and the sharpening plates 608 to the base body 606. According to an embodiment, the holding member 610 may be formed integrally with the base body 606.

The male buckle component 604 may comprise a base body 614, a pair of legs 616 coupled to the base body 614, and a ferro rod between the legs 616 and connected to the base body 614.

The base body 614 may have any suitable shape and design pattern, for example, a safety buckle shape.

The pair of legs 614 may be a pair of resiliently flexible legs, and may be configured to have various shapes. The pair of legs 614 can be received by the female buckle component 602 having a socket portion configured to receive the pair of resiliently flexible legs.

Figure 7:
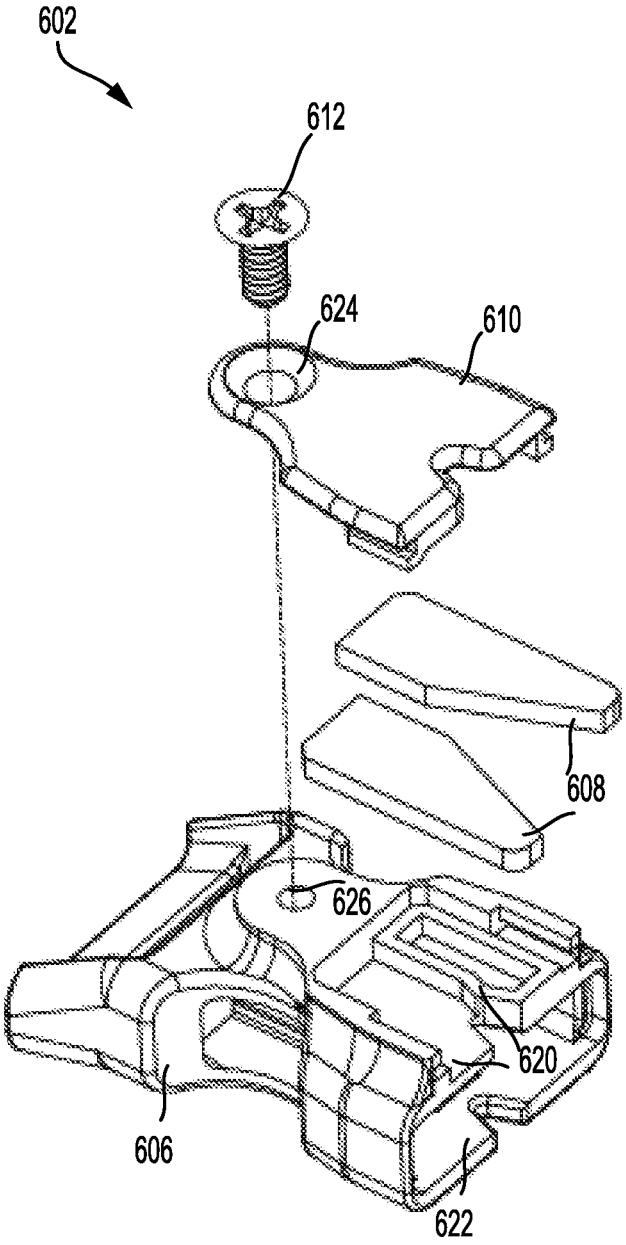
FIG. 7 is an exploded perspective view of the female buckle component showing the sharpener in accordance with the second embodiment.

FIG. 7 illustrates an exploded perspective view of the female buckle component 602 showing the sharpener in accordance with the second embodiment. The female buckle component 602 may comprise the base body 606, the set of sharpening plates 608, the holding member 610, the screw 612, and a sharpener receiver 620 disposed in the base body 606 to receive the set of sharpening plates 608.

The sharpening plates 608 may be at least partially or completely disposed in the sharpener receiver 620 extend outwardly therefrom. In addition, one plate (referred as a first sharpening plate) of the sharpening plates 608 may be positioned adjacent to another plate (referred to as a second sharpening plate) of the sharpening plates 608 to form an angled intersection of the sharpening edge of the first sharpening plate and the sharpening edge of the second sharpening plate.

According to embodiments, the angled intersection may be one of a variety of angles or within a range of angles. For example, the angled intersection may be less than 10°, within a range of about 10° to about 17°, within a range of about 22° to about 30°, greater than about 30°, within a range of about 30° to about 60°, or about 40°. According to an embodiment, the sharpening edge of the first sharpening rod and the sharpening edge of the second sharpening rod may form the angled intersection of about 40°.

The holding member 610 can be capable of affixing the sharpening plates 608 in place when the sharpening plates 108 are received by the sharpener receiving member 620.

The screw 612 may act as a fastener to facilitate holding the holding member 610 and the sharpening plates 108 to the base body 606. The screw 612 may pass through a through hole 624 in the holding member 610 and be fixed into a partially or fully threaded bore 626 in the base body 606. The screw 612 may be threaded or without threads, and may be any type and size, for example, smooth shank, ring shank, screw shank, etc.

The sharpener receiver 620 disposed in the base body 606 may be configured to receive the set of sharpening plates 608. The sharpener receiver 620 may be configured as a set of recesses in the base body 606, and may have varying shapes and dimensions depending on the sharpening plates 608.

In some embodiments, screws or other fasteners may not be needed to facilitate affixing the holding member 610 and the sharpening plates 608 to the base body 606. For example, the holding member 610 may be configured to snap into the sharpener receiver 620, or be glued into to the sharpener receiving member 620. In some embodiments, the screws or other fasteners may be configured to fasten the holding member 610 from one side of the holding member 610 instead of the top of the holding member 610 as shown in FIG. 7.

In some embodiments, the holding member 610 may not be needed to affix the sharpening plates 608 in place when the sharpening plates 608 are received by the sharpener receiving member 620. Other methods may be applied to fasten the sharpening plates 608. For example, the sharpening plates 608 may be fastened by a set of screws each threaded into the sharpener receiver 620 from side surfaces of the base body 606.

The socket portion 622 may be configured to receive the pair of resiliently flexible legs 616 of the male buckle component 604, when the male buckle component 604 is coupled to the female buckle component 602.

FIG. 8 illustrates a perspective view of the buckle assembly 600 with the female buckle component 602 having the sharpener, and the male buckle component 604 in accordance with the second embodiment. The buckle assembly 600 may comprise the female buckle component 602 having the sharpener as described above and the male buckle component 604. The female buckle component 602 may be configured to receive the male buckle component 604 by receiving the pair of extended legs 616 of the male buckle component 604.

Figure 9:
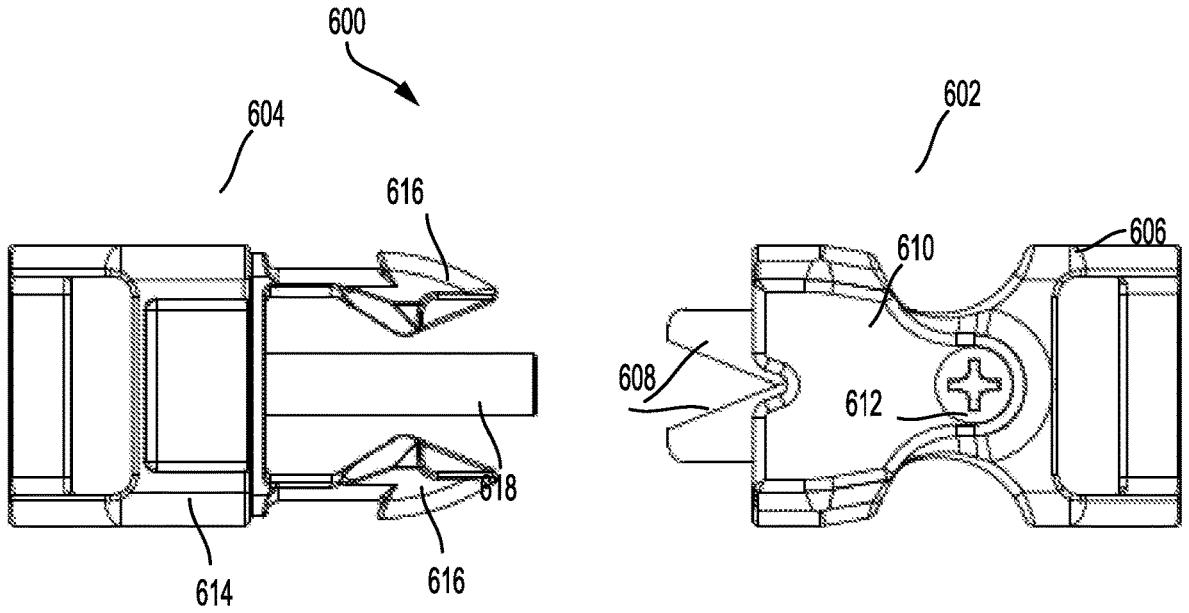
FIG. 9 is a top view of the buckle assembly with the female buckle component having the sharpener, and the male buckle component in accordance with the second embodiment.

FIG. 9 is a top view of the buckle assembly 600 with the female buckle component 602 having the sharpener, and the male buckle component 604 in accordance with the second embodiment. As can be seen, the sharpening plates 608 form an angled intersections such that a cutting tool blade may be placed in between the angled intersection for being sharpened.

Figure 10:
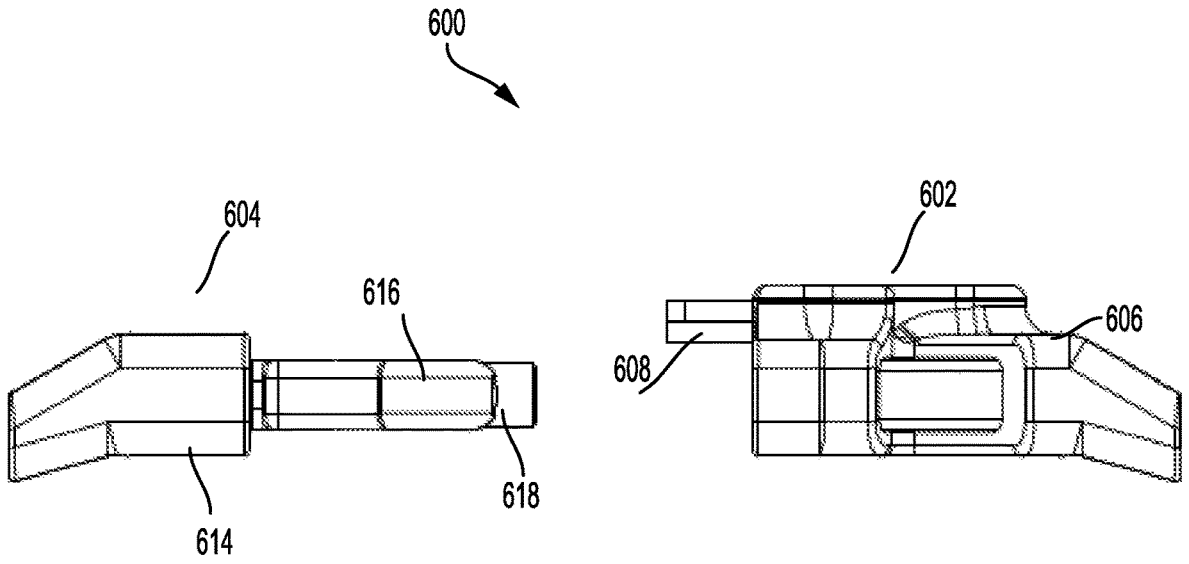
FIG. 10 is a side view of the buckle assembly with the female buckle component having the sharpener, and the male buckle component in accordance with the second embodiment.

FIG. 10 is a side view of the buckle assembly 600 with the female buckle component 602 having the sharpener, and the male buckle component 606 in accordance with the second embodiment. As can be seen, further details of the buckle assembly 600 are illustrated, for example, the shape sand profiles of the male buckle component 604 and the female buckle component 602.

Embodiment 3

Figure 11:
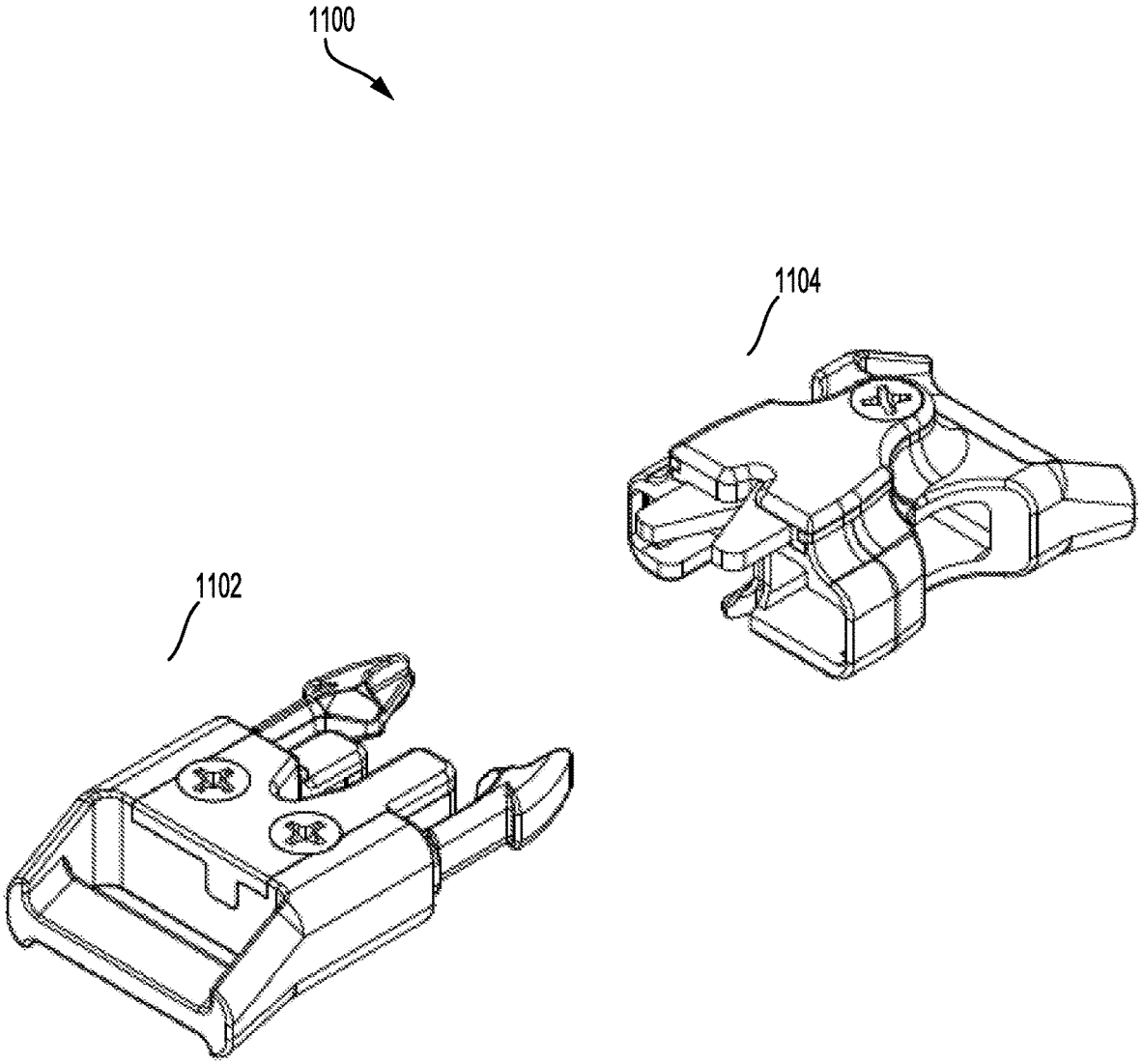
FIG. 11 is a perspective view of a buckle assembly with a male buckle component having a first sharpener and a female buckle component having a second sharpener, in accordance with a third embodiment.

FIG. 11 is a perspective view of a buckle assembly 1100 with a male buckle component 1102 having a first sharpener and a female buckle component 1104 having a second sharpener, in accordance with a third embodiment. The male buckle component 1102 may be the same or substantially the same as the male buckle component having a sharpener described above for fine sharpening a cutting tool, and the female buckle component 1104 may be the same or substantially the same as the female buckle component having a sharpener described above for coarse sharpening a cutting tool. Details may be referred to the above description. For example, the buckle assembly may be provided with both fine sharpening and coarse sharpening sharpeners.

Figure 12:
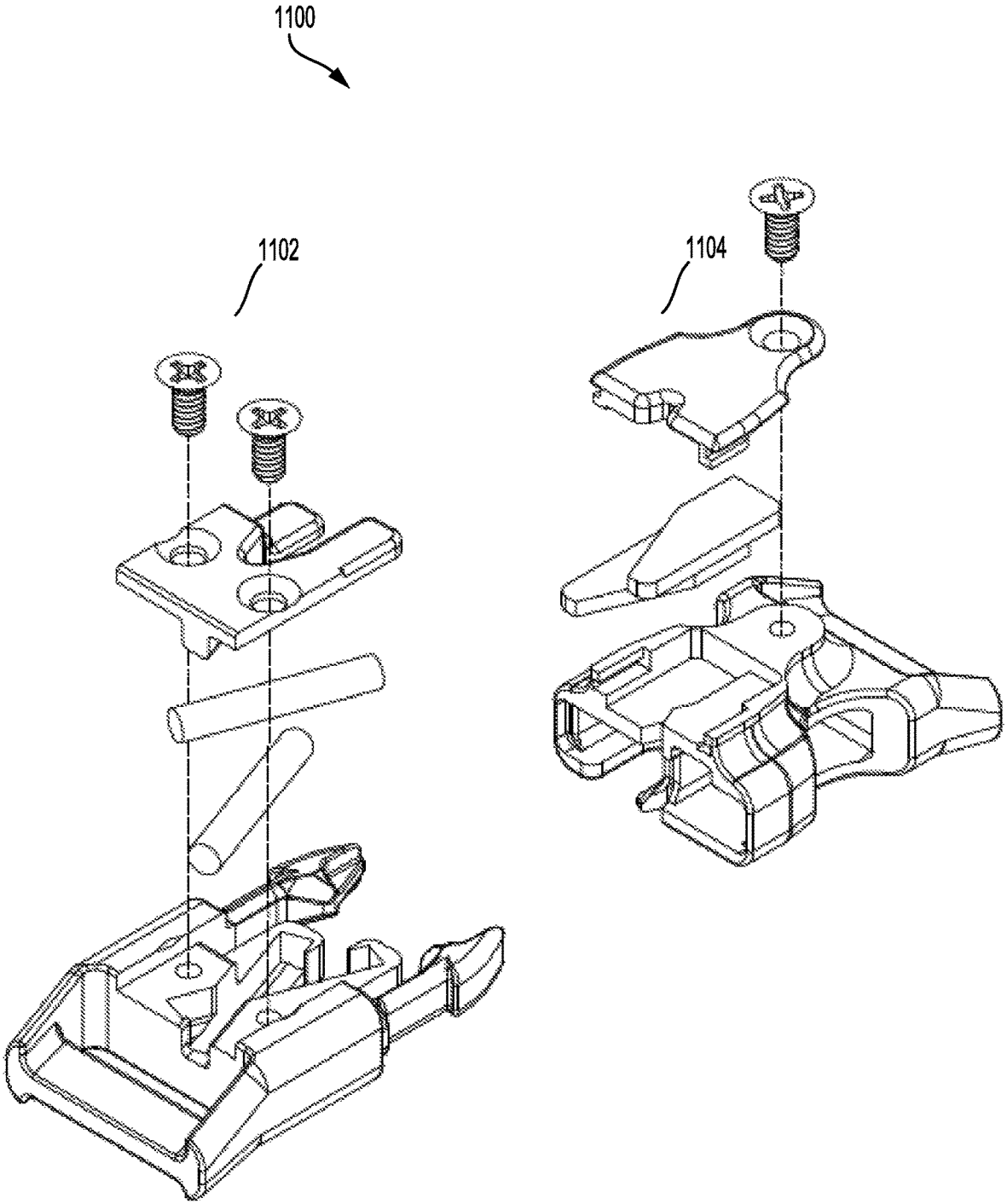
FIG. 12 is a first exploded perspective view of the buckle assembly with the male buckle component and the female buckle component in accordance with the third embodiment.

FIG. 12 is a first exploded perspective view of the buckle assembly 1100 with the male buckle component 1102 and the female buckle component 1104 in accordance with the third embodiment. As said, Details may be referred to the above description.

Figure 13:
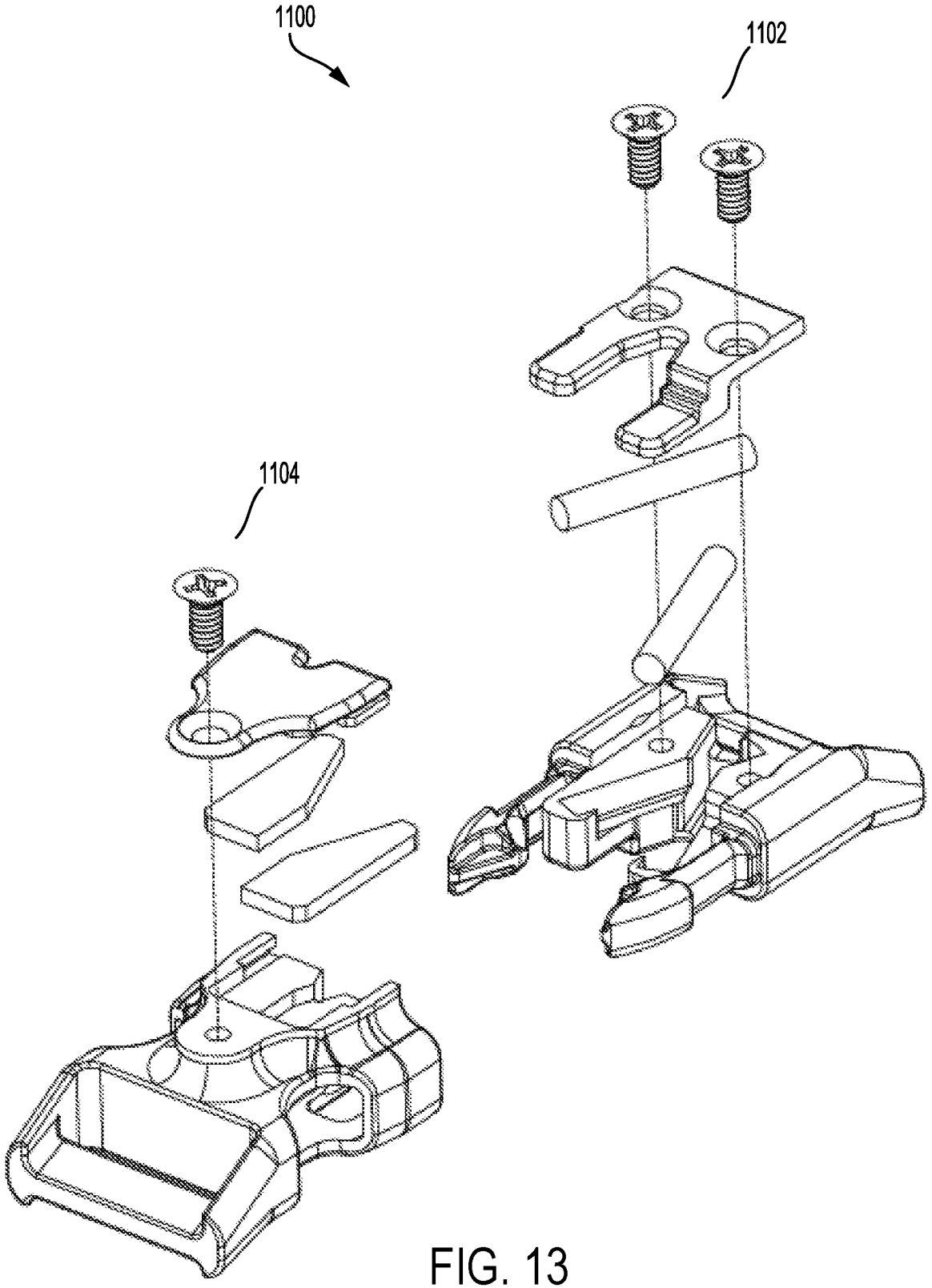
FIG. 13 is a second exploded perspective view of the buckle assembly with the male buckle component and the female buckle component in accordance with the third embodiment.

FIG. 13 is a second exploded perspective view of the buckle assembly 1100 with the male buckle component 1102 and the female buckle component 1104 in accordance with the third embodiment. As said, Details may be referred to the above description.

Figure 14:
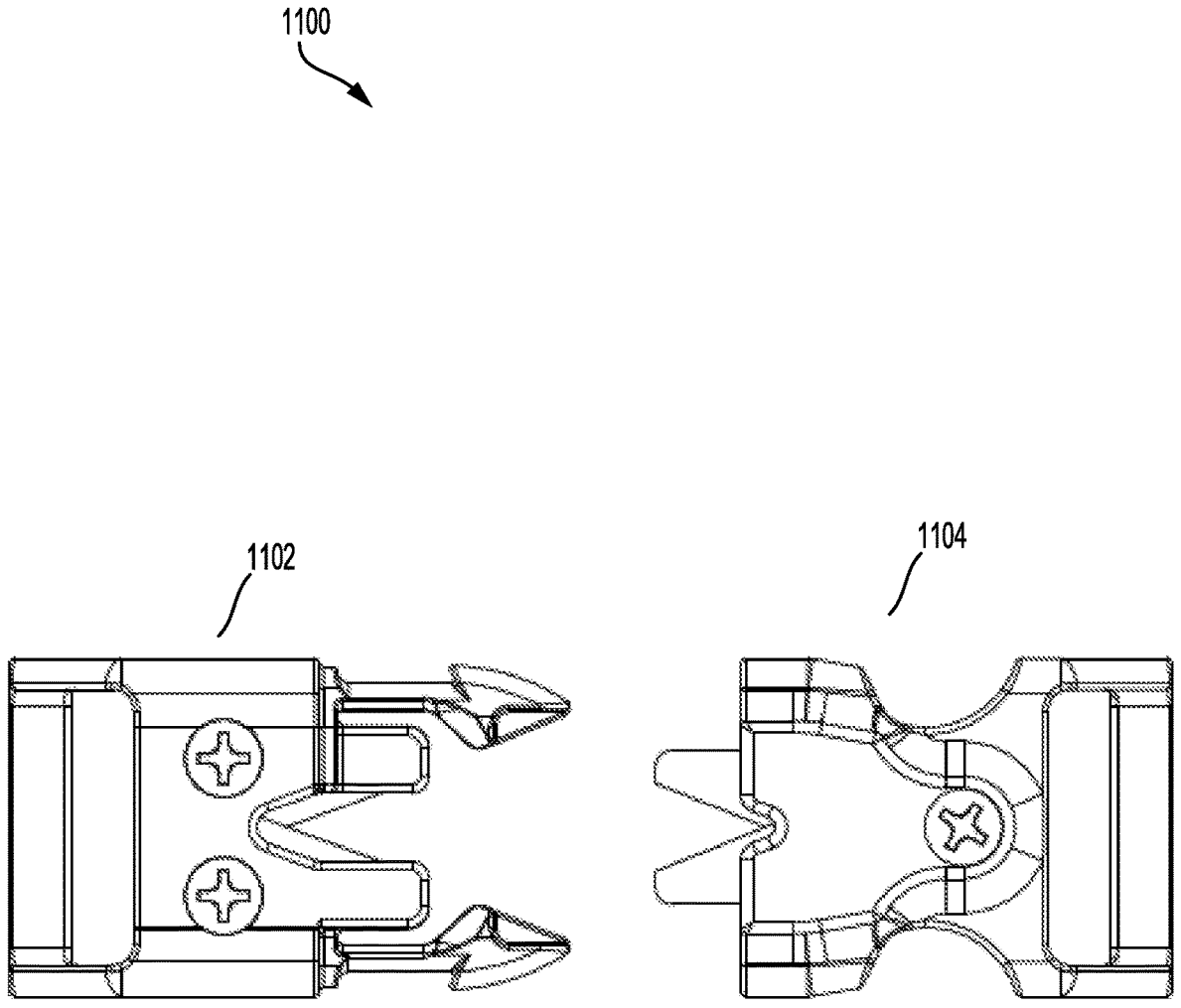
FIG. 14 is a top view of the buckle assembly with the male buckle component and the female buckle component in accordance with the third embodiment.

FIG. 14 is a top view of the buckle assembly 1100 with the male buckle component 1102 and the female buckle component 1104 in accordance with the third embodiment. As said, Details may be referred to the above description.

Figure 15:
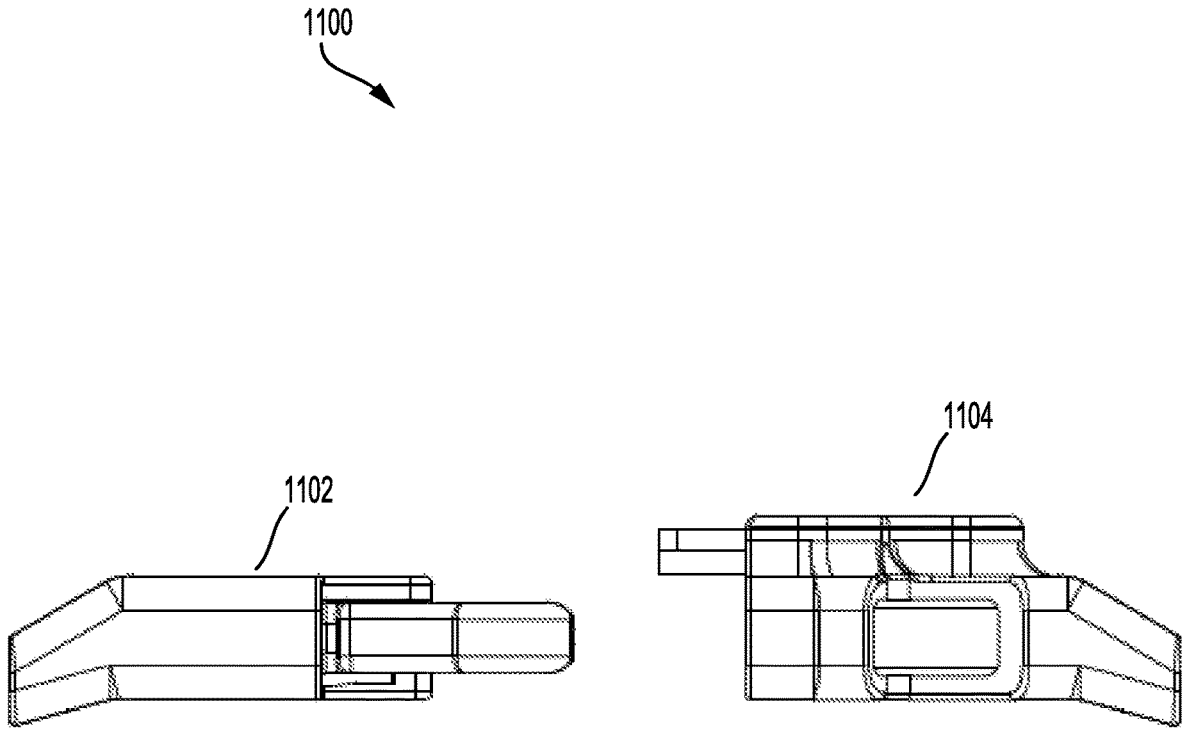
FIG. 15 is a side view of the buckle assembly with the male buckle component and the female buckle component in accordance with the third embodiment.

FIG. 15 is a side view of the buckle assembly with the male buckle component and the female buckle component in accordance with the third embodiment. As said, Details may be referred to the above description.

Figure 16:
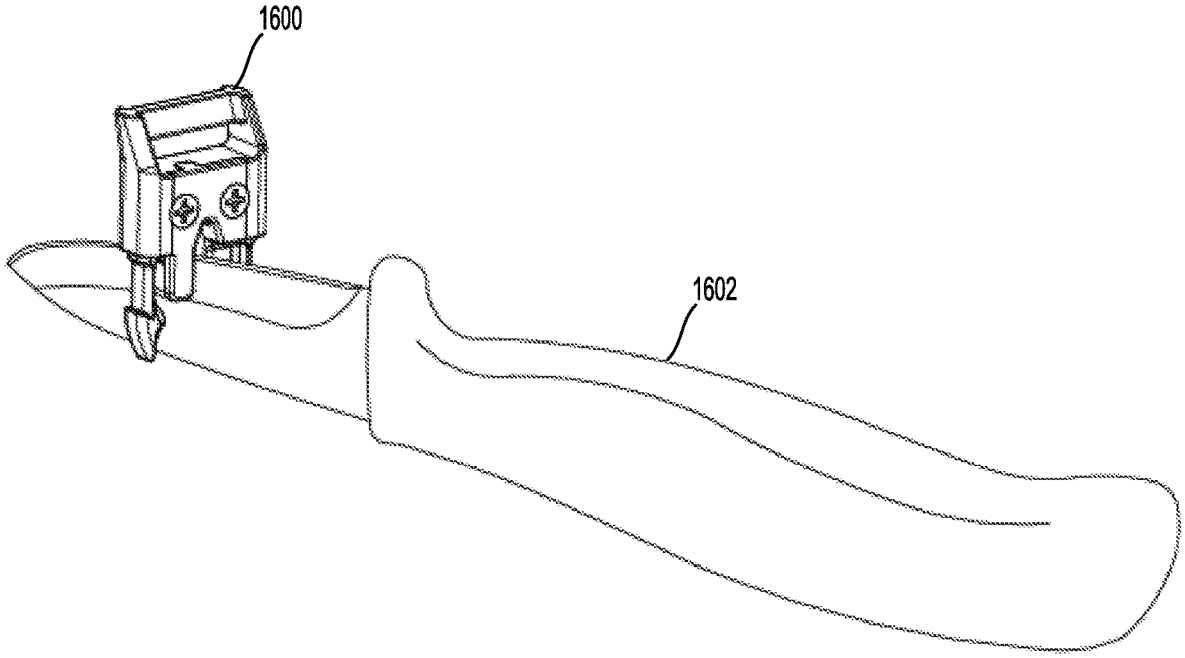
FIG. 16 is a perspective view of a male buckle component having a sharpener engaged a cutting tool in accordance with some embodiments.

FIG. 16 is a perspective view of a male buckle component 1600 having a sharpener engaged with a cutting tool in accordance with some embodiments. The male buckle component 1600 may be the same or substantially the same as the male buckle component having a sharpener described above, such as for fine sharpening of a cutting tool. Details may be referred to the above description. As can be seen, the male buckle component 1600 may sharpen a blade of a cutting tool 1602 (e.g., a knife) using the sharpener of the male buckle component 1600. When sharpening, the male buckle component 1600 can be stationary or the blade of the cutting tool 1602 can be stationary. That is, the male buckle component 1600 may be moved along the length of the blade of the cutting tool 1602 to sharpen the blade, or the blade may be moved relative to the fixed male buckle component 1600. Also when sharpening, both the male buckle component 1600 and the blade of the cutting tool 1602 may be moving with respect to each other.

Figure 17:
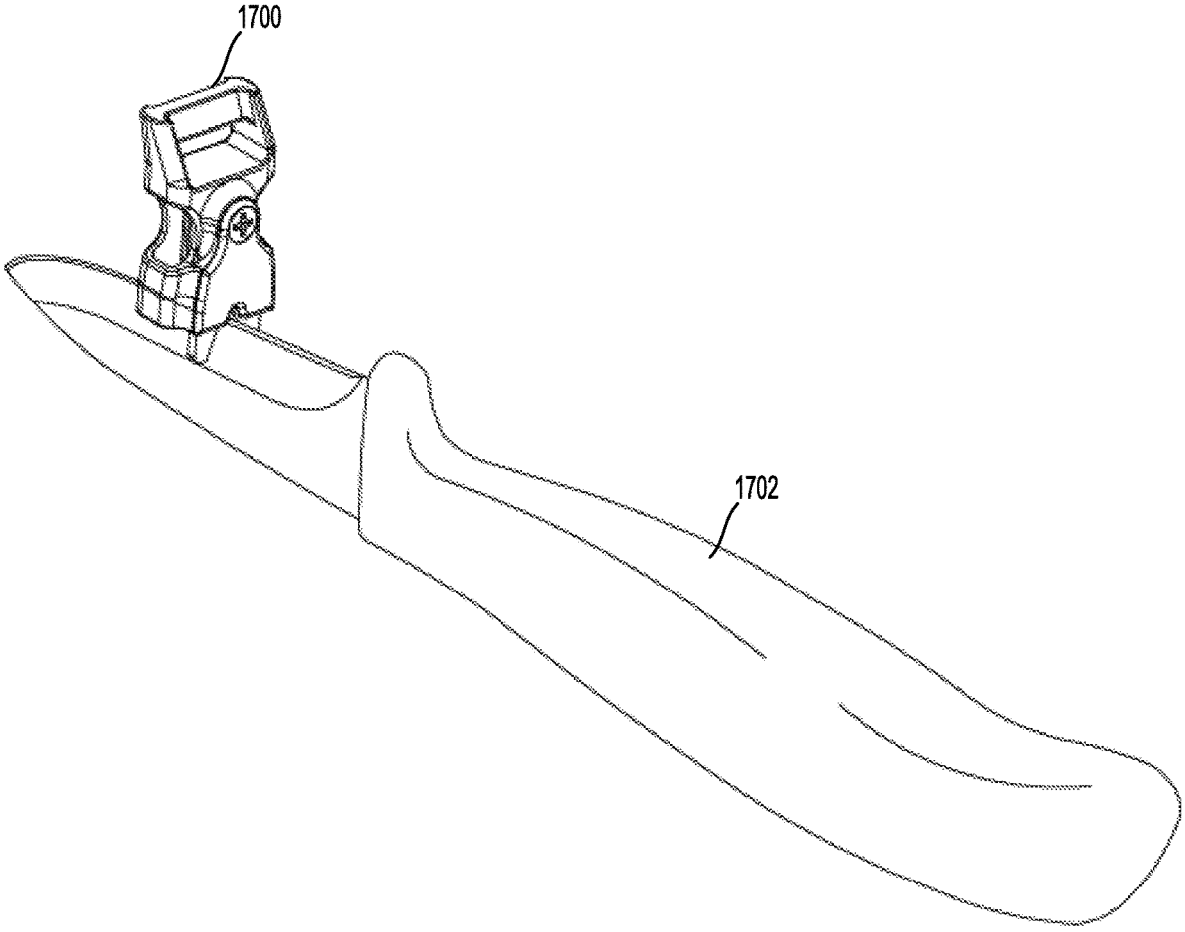
FIG. 17 is a perspective view of a female buckle component having a sharpener engaged a cutting tool in accordance with some embodiments.

FIG. 17 is a perspective view of a female buckle component 1700 having a sharpener engaged a cutting tool in accordance with some embodiments. The female buckle component 1700 may be the same or substantially the same as the female buckle component having a sharpener described above, such as for coarse sharpening a cutting tool. Details may be referred to the above description. As can be seen, the female buckle component 1700 may sharpen a blade of a cutting tool 1702 (e.g., a knife) using the sharpener of the female buckle component 1700. When sharpening, the female buckle component 1700 can be stationary or the blade of the cutting tool 1702 can be stationary. That is, the female buckle component 1700 may be moved along the length of the blade of the cutting tool 1702 to sharpen the blade, or the blade may be moved relative to the fixed female buckle component 1700. Also when sharpening, both the female buckle component 1700 and the blade of the cutting tool 1702 may be moving with respect to each other.

As disclosed herein, the buckle assembly may be made of any suitable materials, for example, plastics (e.g., ABS, POM, Acetal, Polycarbonate, polypropylene, etc.) The various components of the buckle assembly may be made of the same material or different materials. For example, the whole buckle assembly may be made of a same plastics. One or more components of the buckle assembly may be made of a first type of plastics, and other components of the buckle assembly may be made of a second type of plastics, a metal, or other suitable materials.

Further, the disclosed buckle assembly may be manufactured using different methods. For example, each part of the male buckle component or the female buckle component may be manufactured separately, and then assembled together to form the disclosed buckle assembly. Two or more parts, or a whole of the male buckle component or the female buckle component may be manufactured integrally. For example, the sharpening receiver may be integral with the base body. The manufacturing process may include, but not limited to cutting, pressing, protruding, casting, molding, 3D printing, etc.

I claim:

1. A quick release buckle assembly comprising:

a male buckle component having a pair of resiliently flexible legs and a sharpener receiver disposed between the pair of resiliently flexible legs, wherein the sharpener receiver comprises a lower receiving area and an upper receiving area;

a female buckle component having a socket portion configured to receive the pair of resiliently flexible legs and the sharpener receiver disposed between the pair of resiliently flexible legs; and a first sharpening rod having a first sharpening edge and a second sharpening rod having a second sharpening edge, wherein the first sharpening rod is at least partially disposed in the lower receiving area and the second sharpening rod is at least partially disposed in the upper receiving area, wherein the first sharpening edge and the second sharpening edge are at least partially exposed from the male buckle component and configured to sharpen a blade, wherein, when the male buckle component is received by the female buckle component, the first sharpening edge and the second sharpening edge are at least partially covered by the female buckle component.

2. The buckle assembly of claim 1, wherein the second sharpening rod is positioned on the first sharpening rod to form an angled intersection of the first sharpening edge and the second sharpening edge.

3. The buckle assembly of claim 2, wherein the first sharpening edge and the second sharpening edge form the angled intersection of about 40°.

4. A quick release buckle assembly comprising:

a male buckle component having a pair of resiliently flexible legs;

a female buckle component having a first socket portion configured to receive the pair of resiliently flexible legs and a sharpener receiver;

wherein the sharpener receiver comprises a lower receiving area and an upper receiving area;

a first sharpening plate having a first sharpening edge and a second sharpening plate having a second sharpening edge, wherein the first sharpening plate is at least partially disposed in the lower receiving area and the second sharpening plate is at least partially disposed in the upper receiving area and extend outwardly therefrom, wherein the first sharpening edge and the second sharpening edge are at least partially exposed from the female buckle component and configured to sharpen a blade, wherein, when the male buckle component is received by the female buckle component, the first sharpening plate and the second sharpening plate are adjacent to a top surface of the male buckle component.

5. The buckle claim 4, wherein the second sharpening plate is positioned above the first sharpening plate to form an angled intersection of the first sharpening edge and the second sharpening edge.

6. The buckle of claim 5, wherein the first sharpening edge and the second sharpening edge form the angled intersection of about 40°.

* * * * *